United States Patent [19]

Schippers

[11] 3,999,909

[45] Dec. 28, 1976

[54] SPINNING APPARATUS WITH PNEUMATIC FILAMENT CONVEYOR TUBE

[75] Inventor: Heinz Schippers, Remscheid, Germany

[73] Assignee: Barmag Barmer Maschinenfabrik Aktiengesellschaft, Wuppertal, Germany

[22] Filed: July 28, 1975

[21] Appl. No.: 599,632

[30] Foreign Application Priority Data

Aug. 9, 1974 Germany ..... 2438364

[52] U.S. Cl. ..... 425/72 S; 28/71.3; 242/18 A; 425/455 F

[51] Int. Cl.[2] ..... D01D 7/00

[58] Field of Search ..... 425/72 S, 377, 455 F; 28/71.3; 242/18 A

[56] References Cited

UNITED STATES PATENTS

| | | | |
|---|---|---|---|
| 3,274,644 | 9/1966 | Massey et al. | 425/72 S |
| 3,913,852 | 10/1975 | Lenk et al. | 242/18 A |
| 3,930,292 | 1/1976 | Schippers et al. | 28/71.3 |

FOREIGN PATENTS OR APPLICATIONS

| | | | |
|---|---|---|---|
| 36,207 | 11/1972 | Japan | 425/72 S |

*Primary Examiner*—Robert D. Baldwin
*Attorney, Agent, or Firm*—Johnston, Keil, Thompson & Shurtleff

[57] ABSTRACT

The combination of a spinning nozzle and hollow, vertical, blowing and drop shafts for cooling and solidifying the spun filaments, with winding means for winding the spun, solidified filaments; pneumatic tube means for conveying the filaments from the lower end of the lower cooling shaft to an automatic filament-catching means on a chuck of the filament winder, said pneumatic tube means having longitudinal slot to allow withdrawal of the filaments as they become tensioned at the beginning of the winding; a threading plate in one of the hollow shafts, and a telescopic drop shaft construction providing an opening and closing of cooling gas exit opening by the telescopic shifting of the drop shaft.

8 Claims, 5 Drawing Figures

SPINNING APPARATUS WITH PNEUMATIC FILAMENT CONVEYOR TUBE

In apparatus for producing melt-spun filaments and the subsequent winding thereof, one problem occurs at the commencement of the spinning process. In conducting the filaments through the filament cooling and solidifying, hollow shaft or shafts, which may comprise an upper, hollow, vertical blowing shaft and a lower, hollow, vertical drop shaft, the filaments emerging from the lower end of the drop shaft have to be caught and wound on a winding unit. The filaments may pass directly from the drop shaft to the winding unit or over intermediate godets. At the commencement of the spinning process the filaments do not have uniformity of the usual character. Rather, the filaments have irregular thicknesses of a stringy texture arising from the gradual solidification of the filaments in the cooling shaft.

Heretofore the aforesaid problem has been solved by utilizing gravity. The stringy filaments, particularly under the weight of their irregular thickenings and irregular material accumulations, drop into the drop shaft where they are caught in its lower part and drawn out of the filament emergence openings. They are then placed on a winding device, either directly or after placement about the aforesaid intermediary draw-off godets. The handling of the filaments emerging from the exit openings of the drop shaft usually is done with a vacuum injector, which draws off the filaments under vacuum and feeds them to a waste container until the filaments are manually placed about and grasped by the winding device or by the godets.

This type of manual placement of the filaments has distinct disadvantages. For example, it involves expenses in operating personnel, who need high skill to efficiently handle the filaments in the initiation of the winding procedure. Such manual operations frequently have failures, particularly where the filaments, or even only individual filaments, get hung up in the cooling shaft and can be removed again only with difficulty.

Also, in the case of a filament break, the cooling shaft begins to fill with stringy partly solid filaments and becomes completely clogged by the semi-plastic and molten filaments.

The object of the subject invention is to avoid the aforesaid disadvantages and to provide apparatus for the spinning and winding of melt-spun filaments where the filaments are placed, without manual attending, on the winding device in an automatic manner. Further, the subject apparatus functions, even in the case of filament breakage, to attain the automatic continuance of filament movement toward the winder and its automatic engagement on the winder.

The subject invention provides a spinning nozzle for the melt-spinning of synthetic polymer filaments in a downward direction. Immediately below the nozzle is a vertical hollow shaft means for the passage of freshly spun filaments longitudinally therethrough. This hollow shaft means has means for supplying a cooling gas, usually air, into and through the hollow shaft means to cool and solidify the molten, spun filaments.

The hollow shaft means preferably comprises an upper, vertical hollow blower shaft having a blowing unit to blow air transversely across the shaft substantially perpendicularly to the direction of movement of the molten filaments longitudinally through the blowing shaft. One wall of such shaft preferably has a hinged door for gaining access to the interior of the shaft for maintenance, inspection, cleaning, etc. The door has a series of shutters or louvers which are ganged together and movable between closed and open positions by a mechanical, pneumatic or hydraulic power unit.

Immediately below and communicating with the blowing shaft is a lower, hollow, vertical drop shaft, having at its lower end an opening of restricted size through which the filaments exit from the hollow shaft. The lower end of the drop shaft preferably has a plurality of openings in its wall and a surrounding duct or chamber for withdrawing cooling gas from the drop shaft via the openings. Such openings and duct chamber may also be used to supply a gas to the lower end of the drop shaft.

In one form, the hollow drop shaft comprises two telescopic segments, the lower segment of which is movable vertically relative to the fixed upper segment. The gas flowing through the drop shaft exists from an opening in the nadir of the tapered lower end thereof. The tapered lower end seats in a matingly tapered passage in the lower wall of the duct or chamber for withdrawing gases from the drop shaft. When seated, withdrawal of such cooling air is precluded. When unseated, cooling gas can flow out of the lower opening in the tapered wall and thence into the hollow chamber or duct, such seating and unseating being accomplished by telescopic movement of the lower segment of the drop shaft.

In order to attain automatic catching and winding of the filaments of the beginning of the spinning-winding operation or to re-engage such filaments in the event of filament breakage, the invention provides a winding unit for the traverse winding of the filaments into the form of a filament package or cheese on a winding tube or bobbin. Such winding means includes pins or other projections which automatically catch the leading ends of the filaments to initiate the winding operation. After initiation, the winding unit automatically engages the filaments to begin the traverse winding, i.e., when the reciprocating traverse guide automatically picks up the filament after initiation of the winding.

In the normal course of the winding, the filaments run from a filament guide which precedes the winding unit. The reciprocating traverse device moves the filaments in what is commonly known as a traverse triangle, a triangular zone embracing the extremes of movement and the filaments between an apexial filament guide and the reciprocating traverse guide.

A feature of the invention is that a continuous airflow supplied by the blower shaft flows continuously through the blowing shaft and drop shaft. This airflow can be set to convey the viscous individual filaments at a constant speed equal to or greater than the speed of extrusion through the shafts and through the filament emergence openings to the filament winding device.

The blowing shaft preferably has operating shutters, preferably in a door through which access to the blowing shaft and drop shaft can be gained for cleaning and maintenance. The blowing shaft has opposite its blown air entrance opening an air exhaust opening, through which the cooling air flowing perpendicular to the filaments can be exhausted. The shutters are conveniently provided in such exhaust opening. It is further essential for purposes of the invention that the cooling air flowing perpendicularly to the running direction of the filaments in the blowing shaft be able to be deflected in the filament-running direction and, with forced air supply if need be, guided into the drop shaft. In the latter, the airflow is generated with a constant or increasing velocity.

For purposes of automation of the subject spinning installations, there may be provided a filament-break detector which, upon filament breakage, triggers the closings of all of the openings of the shafts and, if necessary, also triggers the operation of additionally-need air injectors.

Another feature of the invention pertains to the gathering or collection of the individual filaments in the blowing shaft or in the upper zone of the drop shaft into a filament bundle. The early collection or gathering of the individual filaments into a filament bundle has the advantage that the bundle can be worked while it is still in the blowing shaft or drop shaft. An example of such working is applying turbulence to the bundle by means of an air jet blown transversely therethrough. Another example is that of applying a finishing composition. A still further example is false twisting of the bundle.

For the gathering or collection of the filaments, the invention provides a guide plate having a small, filament bundle passage substantially coaxial center thereof. This guide plate extends traversely across the blowing shaft or drop shaft. The guide plate has a guide passage in the side of the plate which is opposite to the opening through which the cooling air is blown transversely to the direction of filament travel. The edges of the passage converge toward the small opening in the guide plate, which is approximately at the center of the slot shaft. These edges preferably slope downwardly toward the center of the shaft and the opening in the guide plate. Such guide plate thus allows the leading end of the filaments to pass through the guide passage. After passing therethrough, and particularly after the filaments pass through the opening at the lower end of the drop shaft and begin to be wound, the filaments are drawn along an edge of the guide passage toward the small passage opening in the guide plate.

Under present-day technology, the spinning and winding of synthetic polymer filaments can be done with or without godets. If the spinning is done without godets, the filaments exiting from the drop shaft are fed directly to the winder. On the other hand, if the spinning is done with godets, the godets serve as a conveying member and determine the draw-off rate of the filaments extruded from the spinning nozzle. After such conveyor godets there may be provided one or more additional godets serving as stretching godets, whereby the spun filaments may be wholly or partially stretched during the spinning process.

At the high spinning rates currently attainable, e.g., 4000 meters per minute or more, a difficult problem lies in the placement of the filaments around the rapidly-running godets. This problem is solved by the subject invention through utilization of a slotted guide tube having longitudinal slots facing the working surfaces of the respective godets. The guide tube is curved about the godets so that the leading end of the filaments can be blown through the guide tube about, but not in contact with, the godets. When the filaments become tensioned at the beginning of their winding, they are drawn out of the slot and onto the working surfaces of the godets.

The invention will be further appreciated by the following description and preferred embodiments of the invention which are illustrated in the drawings wherein.

Figure 1:
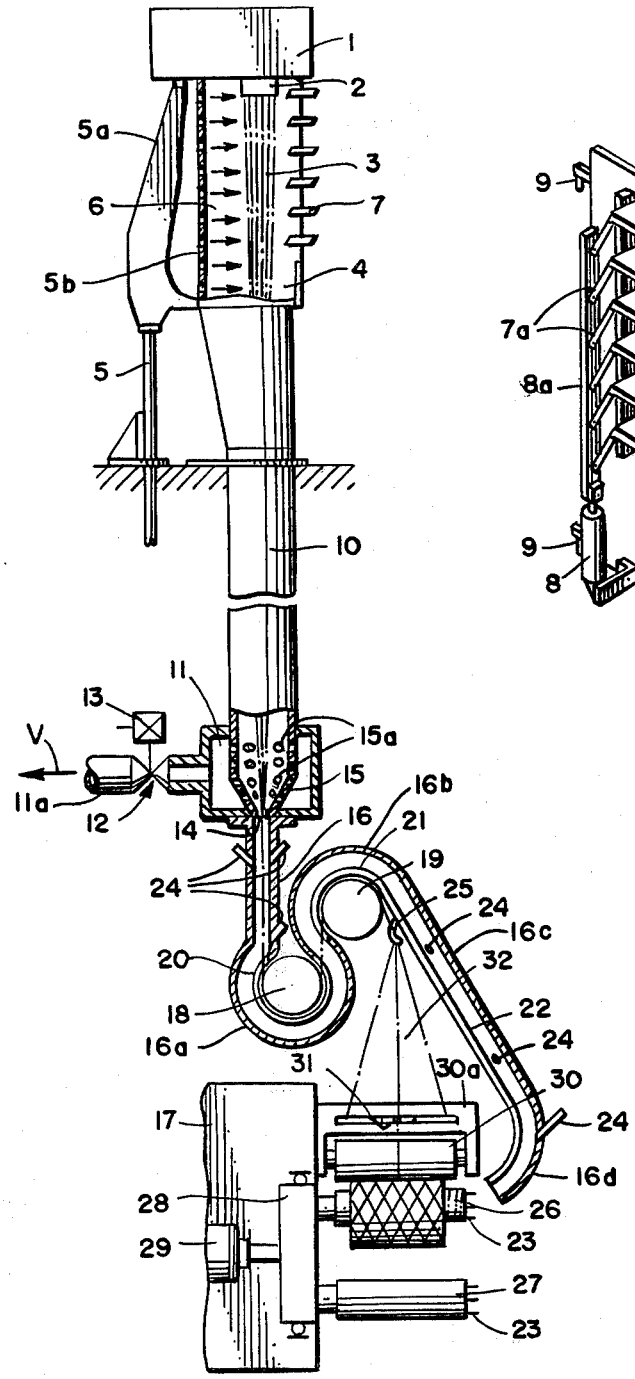
FIG. 1 is a side elevation, partly in section of a first embodiment of a spinning, hollow shaft, godet and winder assembly with a slotted guide tube.

Referring to the drawings, the spinning installation comprises a spinning head 1. The synthetic polymer filaments 3 pass from the spinning nozzle 2 into a hollow, vertical blowing shaft 4. The blowing shaft 4 is supplied with a stream of cooling air 6 via the pipe 5, the manifold **5*a*, and the screen of perforated plate 5*b* on one side of the shaft 4**.

The direction of flow of the cooling air is substantially perpendicular to the direction of movement of the individual filaments 3 passing vertically downwardly through the blowing shaft 4. The cooling air may exit from the opposite side of the blowing shaft between the shutters 7 when they are open.

Figure 2:
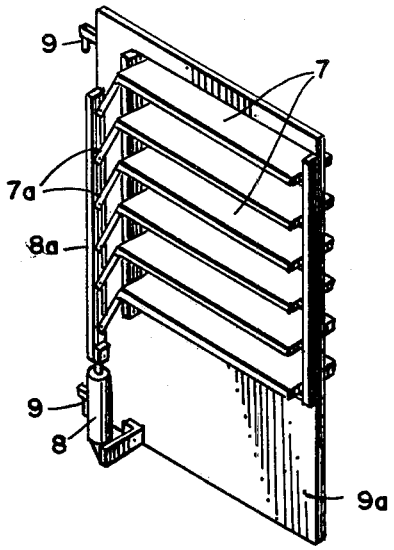
FIG. 2 is a perspective view of a door for the blower shaft with a closeable shutter.

Referring to FIG. 2, the shutters 7 are ganged for opening and closing together by means of the cylinder piston unit 8 and the gang bar **8*a*, to which the shutters 7 are connected by connecting bars 7*a*. The shutters 7 preferably are mounted in an opening of a door 9*a*, which in turn is hung on the wall of the blowing shaft 4 by hinges 9. Thus, it is possible to open the entire door 9*a* by hand to gain access to the blowing shaft for servicing purposes, e.g., to clean the spinning nozzle plate 2. Alternately, the shutters 7 may be opened and closed by activation of the cylinder piston unit 8 in order to regulate the amount of cooling air which can flow out the shuttered opening of the door 9*a***.

Directly beneath the blowing shaft 4 and connected therewith is a hollow, vertical drop shaft 10. The length of the drop shaft is such that the filaments are cooled to the desired temperature before exiting therefrom.

The lower end of the cylindrical drop shaft 10 comprises a conical, funnel-shaped wall 15 having at its tip a small filament outlet opening 14. The conical wall 15 and/or the lower part of the cylindrical drop shaft 10 have small perforations **15*a*. A vacuum device, designated by the arrow V, is connected by the pipe or tube 11*a* with the duct or chamber 11, the latter enclosing the area of the drop shaft tube containing the perforations 15*a*. Cooling air may be drawn off by the vacuum through the perforations 15*a*, duct or chamber 11, and tube 11*a*. The latter has a valve 12 which is opened and closed by a servomotor 13**.

After the filaments pass through the outlet opening 14 they enter the pneumatic thread guide tube 16 having a first vertical segment which is coaxial with the outlet opening 14. The tube 16 has segments **16*a* and 16*b* which pass curvately counterclockwise and clockwise about the working surfaces of the godets 18 and 19**.

Air or other cooling gas which blows through the outlet opening 14 conveys the leading end of the filaments into the tube 16 and through its curvate portions **16*a* and 16*b*. If desired, the guide tube 16 may have auxiliary tubes 24 extending through its walls at an angle in the direction of movement of gas and filaments through the guide tube 16. Auxiliary gas, e.g., air, may be supplied by the tubes 24** to provide additional impetus to the movement of the leading end of the filaments through the guide tube.

The segment 16*a* of the guide tube has a longitudinal slot 20 facing the filament-contacting working surface of the godet 18. The length of the slot is slightly greater than the working surface of the godet 18, i.e., the surface which contacts the filament passing thereover (approximately 180°).

The segment 16*b* of the guide tube has a longitudinal slot 21 facing the filament-contacting, working surface of the godet 19. The slot 21 begins before the initial filament-contacting portion of the working surface of the godet 19 and continues around the godet 19. It merges with the longitudinal slot 22 in the diagonal, straight segment 16*c* of the guide tube 16. The slot 22 continues through the terminal, curved end 16d of said guide tube. Further details for the guide tube 16, and particularly its segments 16a and 16b which extend about the godets, are set forth in U.S. application Ser. No. 546,600, filed Feb. 3, 1975, now U.S. Pat. No. 3,930,292.

After the leading end of the filaments passes through the curvate segments 16*a* and 16*b*, the leading end is blown through the segments 16*c* and 16*d* of the thread guide tube. The downstream end 16*d* of the thread guide tube is located opposite the free end of a chuck 26 of the thread winding unit 17. The chuck 26 has on its free end a plurality of filament-catching pins or hooks 23. The latter catch the leading end of the filaments while the chuck is rotating. Upon such catching, the filaments become tensioned, whereupon they are pulled out of the guide tube 16 through the slots 20, 21 and 22 and become engaged with the working surfaces of the godets 18 and 19. Further, the filaments are caught by the traverse member 31 of the traverse unit of the filament winding device 17 and being to be wound in the normal traverse winding operation. A hook 25, which is mounted on thread guide tube 16, catches the running filaments and serves as the apex of the traverse triangle 32. The latter is a planar triangle through which the filaments run from the hook 25 through the traverse guide 31 as the latter reciprocates during the winding function.

The winding unit 17 comprises a bobbin revolver 28 which is rotatably driven by the motor 29. This bobbin revolver rotatably supports two chucks 26 and 27, each bearing the afore-described filament-catching pins or hooks 23. A friction drive roller 30 is mounted together with the traverse guide member and its drive on a heat 30a which can move up and down in guides (not shown) in dependence on the diameter of the winding formed on the working chuck, i.e., the chuck and its winding which are in frictional contact with the drive roller 30. After the winding is completed on the working chuck 26, the chuck 27 with an empty winding tube or bobbin is revolved into working position by the bobbin revolver 28, whereupon the completed winding on the chuck 26 can be withdrawn and replaced by an empty tube or bobbin.

The apparatus of FIG. 1 is placed into operation by operating the servo members 8 and 13 to close the shutters 7 and valve 12. Flow of air into the ejectors 24 along the length of the guide tube 16 is initiated. The result is a continuous air stream in which the cooling air stream is deflected into the drop shaft and exits into the filament thread guide tube 16. The ejectors 24 emit such an amount of air to preclude, especially in the lower, conical end 15 of the drop shaft, the buildup of a back pressure in the drop shaft. Care is taken to assure that the air flow in the blowing shaft, the drop shaft, and the filament guide tube 16 is continuous and substantially constant or, more preferably, has an increasing flow of velocity.

In the curvate 16*a* and 16*b*, the ejectors may be arranged so that the leading end of the filaments will be conducted within the segments 16*a* and 16*b* about the godets 18 and 19. As a result of the tension in the filaments created by the air stream applied against the filaments in the segment 16*c*, they may emerge from the slots 20 and 21 and become engaged by the working surfaces of the godets 18 and 19 before the filaments are engaged by the pins or hooks 23.

As soon as the filaments have been grasped by the filament-catching pins or hooks 23, filaments, now under greater tension, are drawn from the slot 22 (and slots 20 and 21 if not previously drawn therefrom) and are grasped by the reciprocating traverse guide 31, which may be a self-catching thread guide and/or spiral thread guide grooves of known construction. Once so caught, the filaments are wound on the working chuck 26 of the winding unit.

As soon as the filaments become engaged by the filament catching pins or hooks 23, the shutter 7 and the valve 12 can be opened, and the ejectors 24 can be turned off. Then the cooling air is drawn of from the bottom of the drop shaft 10 through the perforations 15*a*, the duct or chamber 11 and the tube 11*a*. By the aforesaid closing of the valve 12, the tendency of the freshly spun filaments to enter the perforations 15*a* in the drop shaft is eliminated. The latter result may also be achieved by reversing the air flow through the cooling air draw-off unit, i.e., by blowing a weak air stream through the perforations 15*a* into the drop shaft. In this case the valve 12 is left open when the weak air stream is supplied through the tube 11*a*. If desired, the drop shaft, especially at its lower tapered end 15, may be provided with ejectors which blow the filaments through the filament exit opening 14.

When the bobbin or winding on the working chuck 26 becomes a full or complete winding, the bottom revolver 28 is rotated 180° by its motor 29 to initiate winding on an empty tube or bobbin placed on the chuck 27. The changeover can be effected without waste loss of the filaments by a bobbin revolver winding units known in the art. Exemplary thereof are bobbin winding units described in U.S. application Ser. No. 456,222, filed Mar. 29, 1974, now U.S. Pat. No. 3,913,852.

In the event of filament breakage, the aforesaid functions for feeding the leading end of the filaments through the drop shaft 10 and guide tube 16 can be re-initiated. This may be done automatically through controls operable through a signal from a filament detector which emits such signal in the absence of filament passing normally through the drop shaft, about the godets and onto the winder.

Figure 3:
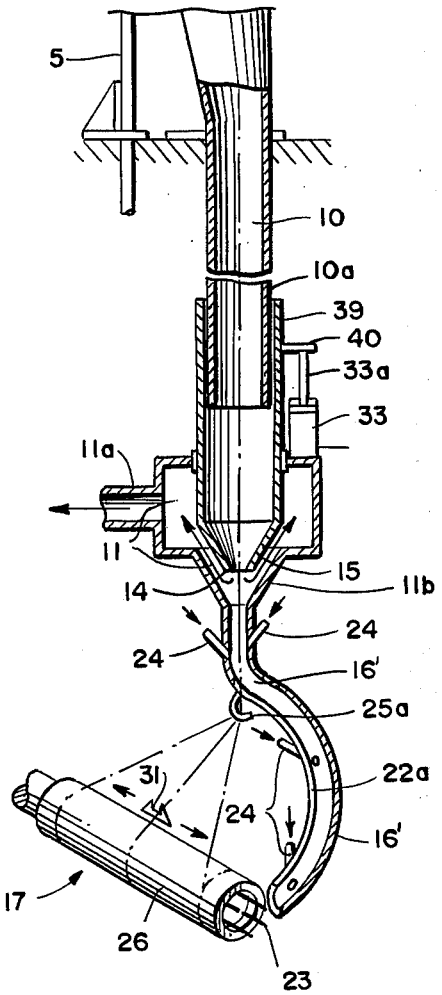
FIG. 3 is a fragmentary side elevation, partly a cross section, of another embodiment of a spinning installation without the use of godets between the exit end of the drop shaft and the winder.

The embodiment of FIG. 3 is similar in many respects to the embodiment of FIG. 1. Accordingly, the upper portion of the apparatus has been omitted and similarly, where applicable, like numerals designate like parts. The two principal differences in the embodiment of FIG. 3 are the construction of the drop shaft, particularly its lower end, and the direct winding of the filaments without use of intermediary godets.

Referring to FIG. 3, the lower end of the drop shaft 10 comprises a stationary, cylindrical tube 10a and a cylindrical shaft segment 39 telescopically fitted thereon whereby the latter can be moved vertically on the drop shaft 10. Such vertically on the drop shaft 10. Such vertical movement may be provided, for example, by a hydraulic or pneumatic cylinder piston unit 33 mounted on the duct or chamber 11 with a projecting piston rod 33*a* connected to an arm 40 on the shaft segment 39.

When the conical or funnel-shaped lower end 15 of the drop shaft segment 39 is seated in the conical or funnel-shaped well 11*b* of the duct or chamber 11, cooling air forced down the drop shaft 10 is precluded from being drawn into the duct or chamber 11 and the tube 11*a*. On the other hand, when the lower drop shaft segment 39 is raised, cooling air can be drawn into the duct or chamber 11*a* and exhausted therefrom as shown by the arrows in FIG. 3.

In initiating the operation of the apparatus of FIG. 3 to attain the engagement of the leading end of the filaments by the catching of the filaments on the hooks or pins 23, the lower drop shaft segment 39 is lowered to seat its conical tip 15 in the conical well 11*b*. The shutters 7 are closed and the ejectors 24 in the filament guide tube 16′ are set in operation by blowing air into the ejectors. The filaments are then conveyed through the thread guide tube 16′, the exit end of which is opposite the hooks or pins 23. Upon engagement of the filaments by the hooks or pins 23, the filaments become tensioned and are drawn out of the longitudinal slot 22*a* of the guide tube 16′, the longitudinal slot 22*a* facing the free end of the chuck 26 and extending from the vicinity of the hook 25*a* to the downstream end of the thread guide tube 16. The filament winder in FIG. 3 is illustrated diagramatically. It may correspond to the winding unit 17 shown in FIG. 1.

It will be appreciated that the drop shaft construction of FIG. 3 can also be used in the godet-containing embodiment of FIG. 1. Conversely, the drop shaft construction of FIG. 1 can be used in conjunction with winders which do not have intermediary godets, i.e., as in the embodiment of FIG. 3.

Figure 4:
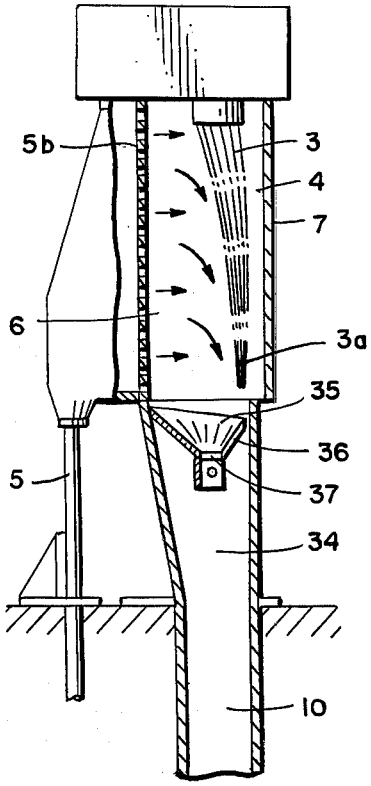
FIG. 4 is a fragmentary side elevation, partly in cross section, of a spinning installation of the type shown in FIGS. 1 and 3, and further containing a filament threading guide plate.
Figure 5:
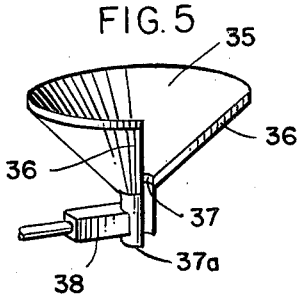
FIG. 5 is a perspective view of the threading guide plate of FIG. 4.

FIGS. 4 and 5 illustrate the use of a filament guide plate 35, which may be fixedly mounted in either a lower part of blowing shaft 4 or the upper part of the drop shaft 10. In the illustrated embodiment the filament guide plate 35 is fixedly mounted in the hollow transitional shaft segment 34, which may be construed as constituting either the lower part of the blowing shaft 4 or the upper part of the draft shaft 10.

The filament guide plate occupies substantially the entire cross section of the hollow shaft, having a recess forming a filament guide passage only on one side thereof. This recess is located on the side of the shaft segment 34 which is opposite to the side in which the blowing air enters the blowing shaft 4 through the perforated plate 5*b*. As can be seen in FIG. 5, the filament guide plate 35 preferably is an inverted cone having a funnel shape with a triangular segment of one part of its conical wall removed, thereby providing filament guide edges 36 and between them the filament passage. The lower end or tip of the conical guide plate 35 has a central opening 37 through which the filaments normally pass. The filament guide edges 36 extend radially from the wall of the shaft segment 34 toward the passage 36 and also run in a downwardly diagonal direction. Thus, the upper wall surface of the guide plate 35 slopes toward the central passage 37 and/or the guide passage between the edges 36.

The filament guide plate functions to lead the leading end 3a of the filaments from the blower shaft 4 into the drop shaft 10 at the beginning of the extrusion operation. This is achieved by closing the shutter 7, whereupon the leading end 3a of the filaments is blown toward the side of the blower shaft which is opposite the perforated plate 5*b*. The blowing air is deflected downwardly as shown by the arrows in FIG. 4 and the leading end of the filaments is diverted in the direction of the triangular passage in the guide plate 35. The descending free end 3*a* of the filaments thereby descend through the opening in the guide plate and are directed by the upper surface of the guide plate toward the filament guide passage 37.

Once the leading end 3a of the filaments passes beyond the guide plate they become slightly tensioned by the increasing airflow speed of the air flowing through the drop shaft 10 and the thread guide 16 or 16′, by godets 18 and 19 (if used), and/or the winding unit 17. Upon such tensioning, the filaments are drawn into and continue to pass through the central opening 37 in the guide plate.

In addition to the guiding function described above, filament guide plate 35, with its central opening 37, can serve as a filament-gathering device in which the bundle of individual filaments is gathered into a predetermined cross section at the upper end of the drop shaft rather than allowing the filaments to pass without gathering into a bundle until they reach the exhaust opening 14 at the lower end of the drop shaft as shown in FIG. 1.

If desired, the central passage 37 of the filament guide plate may be provided with a trough-like extension 37*a* on which is provided a filament-treating or filament-finishing device 38. In the embodiment illustrated in FIG. 5 the device 38 is one for spraying a liquid onto the filament bundle as it passes through the extension 37*a* for the purpose of applying a finishing liquid to the filaments. Alternative filament treatment devices which may be used in lieu of the spray device 38 are air nozzles which provide a tangling of the filament bundle, false-twist devices imparting a false twist by means of an air jet or a rotating friction device or the like.

The invention is claimed as follows:

1. Apparatus for the melt spinning and winding of synthetic polymer filaments which comprises a spinning nozzle for the melt spinning of said filaments in a downward direction, vertical, hollow shaft means immediately below said nozzle for passage of the freshly spun filaments longitudinally therethrough, means for supplying a cooling gas into said hollow shaft means to cool and solidify said filaments, said hollow shaft means having a restricted opening at its lower end for exit of the solidified filaments therefrom, winding means for winding said filaments into a package after their exit from said hollow shaft means and having catching means for filaments to initiate the formation of a winding thereof, reciprocable filament traverse means for movement of said filaments back and forth across said winding, a filament guide preceding said traverse means which together coact to make the filament parts therebetween move through a triangular zone during the traverse of said traverse means with said guide at the upper apex of said triangular zone, pneumatic filament conveyor tube means extending from said restricted opening to an end in the proximity of said catching means, means or flowing gas through said tube means in a direction toward said end of said tube means to convey pneumatically the filaments from said shaft to said filament catching means, and said tube means having a longitudinal slot extending from said end to at least the proximity of said filament guide, said slot facing said winding means, whereby filaments are conveyed through said tube means until they are caught by said filament catching means whereafter, under the tension brought about as said filaments begin to be wound on said package, the filaments are withdrawn from said tube means through said slot.

2. Apparatus as claimed in claim 1, said hollow shaft means comprising an upper, hollow, vertical blower shaft and a lower, hollow, vertical drop shaft having said restricted opening at its lower end, vent means at the lower end of said drop shaft for drawing cooling gas from said drop shaft, said drop shaft being composed of an upper and a lower, telescoped hollow shaft segments, one of which is movable telescopically relative to the other, and means for closing said vent means upon telescopic movement of the movable segment to a predetermined position.

3. Apparatus as claimed in claim 1, said hollow shaft means comprising an upper, hollow, vertical blower shaft and a lower, hollow, vertical drop shaft having said restricted opening at its lower end, and vent means supplying to or for drawing cooling gas from said drop shaft.

4. Apparatus as claimed in claim 1, said hollow shaft means containing a filament guide plate extending traversely across said shaft means, means to blow a stream of cooling gas through an opening in said shaft transversely across said shaft, said guide plate having a guide passage in the side of said plate which is opposite to said opening with edges of said passage converging toward the center of said hollow shaft means, and said edges sloping downwardly toward said center of said plate.

5. Apparatus as claimed in claim 4, said hollow shaft means comprising a cylindrical shaft and said guide plate being as inverted cone having a triangular wall segment moved to form said guide passage.

6. Apparatus as claimed in claim 1, a plurality of rotatable, cylindrical godets positioned in the filament path between said restricted opening and said winding means for conveyance, optionally with stretching, of the filaments over the cylindrical filament-contacting, working surfaces of the rotating godets, said pneumatic filament conveyor tube means extending curvately about the working surfaces of said godets, and the curvate portions of said tube means having respective longitudinal slots facing said working surfaces, said slots having a length sufficient to allow said filaments, when placed under tension to be withdrawn from said tube means and brought into contact with said working surfaces of said godets.

7. Apparatus as claimed in claim 1, wherein said catching means comprises a plurality of filament-catching pins or hooks on the free end of a rotatably driven chuck of said winding means.

8. Apparatus as claimed in claim 1, wherein said hollow shaft means is composed of an upper, vertical, blowing shaft and a lower, vertical, drop shaft through which said filaments pass vertically downwardly, said drop shaft having said restricted opening at its lower end, said means for supplying a cooling gas embodying means for directing a cooling gas stream perpendicularly to the vertical running direction of the filaments running through said blowing shaft, vent means in the lower portion of said drop shaft for drawing cooling gas from said drop shaft, closure means for selectively opening and closing said vent means, and said blower shaft and drop shaft together forming a conduit for a downwardly flowing stream of cooling gas therein, whereby said downwardly flowing stream of cooling gas exits from said restricted opening when said closure means is closed, and said downwardly flowing cooling gas exits principally from said vent means when said closure means is open.

* * * * *

UNITED STATES PATENT AND TRADEMARK OFFICE

CERTIFICATE OF CORRECTION

PATENT NO. : 3,999,909
DATED : December 28, 1976
INVENTOR(S) : Heinz Schippers

It is certified that error appears in the above-identified patent and that said Letters Patent are hereby corrected as shown below:

Column 8, line 62, after "for" insert --catching said--.

Column 9, line 4, change "or" to --for--.

Column 9, line 31, after "supplying" insert --gas--.

Column 10, line 4, change "moved" to --removed--.

Signed and Sealed this

*Seventh* Day of *March 1978*

[SEAL]

*Attest:*

RUTH C. MASON
*Attesting Officer*

LUTRELLE F. PARKER
*Acting Commissioner of Patents and Trademarks*